US011465832B2

(12) United States Patent
Kohen

(10) Patent No.: US 11,465,832 B2
(45) Date of Patent: Oct. 11, 2022

(54) FLEXIBLE TANK

(71) Applicant: LIKUA ENDUSTRIYEL AMBALAJ MALZM. SAN. VE TIC. LTD. STI, Istanbul (TR)

(72) Inventor: Yusuf Kohen, Istanbul (TR)

(73) Assignee: LIKUA ENDUSTRIYEL AMBALAJ MALZM. SAN. VE TIC. LTD. STI, Istanbul (TR)

( * ) Notice: Subject to any disclaimer, the term of this patent is extended or adjusted under 35 U.S.C. 154(b) by 48 days.

(21) Appl. No.: 16/603,853

(22) PCT Filed: Apr. 18, 2018

(86) PCT No.: PCT/TR2018/050171

§ 371 (c)(1),
(2) Date: Oct. 9, 2019

(87) PCT Pub. No.: WO2019/009858

PCT Pub. Date: Jan. 10, 2019

(65) Prior Publication Data

US 2020/0115151 A1 Apr. 16, 2020

(30) Foreign Application Priority Data

Jul. 7, 2017 (TR) ..... 2017/10010

(51) Int. Cl.
*B65D 88/16* (2006.01)
*B65D 88/22* (2006.01)
*B65D 90/04* (2006.01)

(52) U.S. Cl.
CPC ..... *B65D 88/22* (2013.01); *B65D 88/1643* (2013.01); *B65D 88/1656* (2013.01);
(Continued)

(58) Field of Classification Search
CPC ..... B65D 88/16; B65D 88/1643; B65D 88/1656; B65D 88/22; B65D 88/1631;
(Continued)

(56) References Cited

U.S. PATENT DOCUMENTS 2,260,008 A * 10/1941 Michel ..... A45F 3/20 222/107
3,554,256 A * 1/1971 Anderson ..... A61J 1/10 604/408

(Continued)

FOREIGN PATENT DOCUMENTS

CN 206068565 U 4/2017
DE 10140899 A1 3/2003
EP 2527180 A1 11/2012

OTHER PUBLICATIONS

CA International Search Report regarding PCT/TR2018/050171, dated Apr. 4, 2019.

*Primary Examiner* — Jes F Pascua
*Assistant Examiner* — Nina K Attel

(57) ABSTRACT

The present invention relates to a flexible tank wherein liquid can be stored and which can transport liquid from one location to another location by means of a vehicle and having a lower compartment and an upper compartment positioned one above the other. As an improvement, said flexible tank comprises at least one tank body formed by at least one flexible wall joined in a manner forming a flexible pipe-like form and at least one folding region having at least one first folding line and at least one second folding line provided such that a passage throttle is defined in between.

16 Claims, 6 Drawing Sheets

(52) U.S. Cl.
CPC .... *B65D 90/048* (2013.01); *B65D 2590/0066* (2013.01); *B65D 2590/046* (2013.01)

(58) Field of Classification Search
CPC ..... B65D 88/1637; B65D 90/048; B65D 2590/0066; B65D 2590/046; A45F 2003/166; A45F 3/20
USPC ..... 383/38, 901, 3, 105; 229/117.27; 222/94, 107; 220/562–564, 4.12–4.17, 220/4.21–4.25, 6, 7, 501
See application file for complete search history.

(56) References Cited

U.S. PATENT DOCUMENTS

| | | | | | |
|---|---|---|---|---|---|
| 4,411,358 | A * | 10/1983 | Bennwik | A61J 1/10 | 206/771 |
| 5,188,460 | A * | 2/1993 | Dorse | B65D 88/22 | 220/495.06 |
| 2013/0101237 | A1 * | 4/2013 | Kohen | B65D 90/046 | 383/38 |

* cited by examiner

FLEXIBLE TANK

CROSS-REFERENCE TO RELATED APPLICATIONS

This application is a 371 U.S. National Phase of International Application No. PCT/TR2018/050171, filed Apr. 18, 2018, which claims priority to Turkish Patent Application No. 2017/10010, filed Jul. 7, 2017. The disclosures of the above applications are incorporated herein by reference.

TECHNICAL FIELD

The present invention relates to flexible tanks used in any type of liquid transportation and particularly relates to flexible tanks wherein liquid can be stored and having closed form and which can carry liquid from one location to another location by means of a vehicle.

PRIOR ART

The solutions provided by flexible big bags are used for long years for transport of non-fluid materials which are particularly in granule type. As in granule-type materials, flexible big bags or in general terms, flexible carriers are also used in transport of liquid/liquid-based materials. Besides fulfilling the technical requirements in liquid transport like sealing, filling the liquid into the carriage medium and discharging the liquid from the carriage medium and preserving the hygiene of this medium; also the costs which may occur related to transport shall be minimized.

A solution related to usage of flexible tanks for storage and transportation of liquids has been described in GB 2 360 816. GB 2 360 816 describes a disposable flexible tank used for liquid transportation comprising a one piece body portion that is formed using co-extrusion blown film techniques. Two one piece body portions may form an inner liner and outer liner. Each body portion can comprise of two to four layers. Two holes are formed in the tank and are adapted to receive a hose and a pressure relief valve.

EP 0 567 383 describes a fluid storage system comprising a shell, and including a flexible, seamed liner located within the shell. The liner is made oversized relative to the shell so as to reduce stress or tension on the liner seams.

U.S. Pat. No. 4,875,596 describes a flexible vessel for transporting or storing parcels, bulk materials, ammunition, gases or liquids and the same is shaped in the form of a tube, having opens ends tightly sealed by means of straight or line-like clamp connection parts. The clamp connection parts are formed toothed rack-like so that, with relatively short clamp connection parts, tubes with relatively large openings can be sealed tightly.

In the application with number WO 2011/159265, a flexible tank is disclosed having a closed form wherein liquid can be stored and which can carry liquid from one location to the other by means of a vehicle. Accordingly, said flexible tank comprises a lower compartment and an upper compartment one having smaller width or length than the other and positioned one upon the other so that the liquid transfer in between is at least partially prevented. Thanks to said embodiment, the pressure, exerted by the container wherein the flexible tank is positioned, particularly on the door is reduced. This provides prevention of various risks which may occur during usage of the flexible tank. However, said embodiment leads to increase of the producer costs due to the difficulties in production.

As a result, because of all of the abovementioned problems, an improvement is required in the related technical field.

BRIEF DESCRIPTION OF THE INVENTION

The present invention relates to a flexible tank for providing carrying of liquids on vehicles, for eliminating the above mentioned disadvantages and for bringing new advantages to the related technical field.

An object of the present invention is to provide a flexible tank whose production is facilitated.

In order to realize all of the abovementioned objects and the objects which are to be deducted from the detailed description below, the present invention is a flexible tank wherein liquid can be stored and which can transport liquid from one location to another location by means of a vehicle and having a lower compartment and an upper compartment positioned one above the other. Accordingly, said flexible tank comprises at least one tank body formed by at least one flexible wall joined in a manner forming a flexible pipe-like form and at least one folding region having at least one first folding line and at least one second folding line provided such that a passage throttle is defined in between. Thus, the lower compartment and the upper compartment are produced in an integrated manner and thus, production is facilitated. Moreover, without needing an additional process, passage throttle can be obtained which provides liquid passage between the lower compartment and the upper compartment.

In a probable embodiment of the present invention, the folding region is closer to an end part of the tank body than the other one. Thus, when the flexible tank is positioned in a container, the flexible tank contacts the container wall through the lower compartment or through the upper compartment.

In a probable embodiment of the present invention, the upper compartment comprises at least one joining region defined at the part thereof which seats onto the lower compartment.

Thus, the lower compartment and the upper compartment are connected to each other.

In a probable embodiment of the present invention, at least one passage opening is provided at the joining region. Thus, liquid transfer is provided between the lower compartment and the upper compartment.

In a probable embodiment of the present invention, at least one connection part extends between the outer wall of the upper compartment and the outer wall of the lower compartment. Thus, separation of the upper compartment from the lower compartment due to liquid pressure and returning of the upper compartment to the position which exists prior to folding are prevented.

In a probable embodiment of the present invention, the connection part extends between the end parts of the lower compartment and the upper compartment. Thus, the lower compartment and the upper compartment are connected in a rigid manner and the flexible tank preserves its form.

In a probable embodiment of the present invention, at least one valve is provided on the flexible tank. Thus, liquid can be filled into the flexible tank and liquid can be discharged from the flexible tank.

In a probable embodiment of the present invention, at least one tension belt is connected to the tank body. Thus, the flexible tank is fixed into the container.

In a probable embodiment of the present invention, at least one belt housing is provided through which the tension belt passes. Thus, sliding of the tension belt from the tank body during filling or transporting of the flexible tank is prevented.

In a probable embodiment of the present invention, the tension belt is positioned in a manner grabbing the tank body through the vicinity of the end part of the upper compartment.

In a probable embodiment of the present invention, the tension belt is positioned in a manner grabbing the tank body through the vicinity of the end part of the lower compartment.

In a probable embodiment of the present invention, the tension belt is positioned in a manner grabbing the tank body through the vicinity of the folding region.

In a probable embodiment of the present invention, pluralities of tension belts are provided such that there is a predetermined distance in between in the vicinity of the folding region.

Moreover, the present invention is a flexible tank production method. Accordingly, the following steps are provided: bending and joining at least one flexible wall and forming into a pipe-like form and forming a tank body, and folding the tank body through a folding region.

In a probable embodiment of the present invention, the following step is provided: welding and joining the upper compartment and the lower compartment, obtained after folding the tank body, through a joining region.

In a probable embodiment of the present invention, the following step is provided: forming at least one passage opening formed in a manner allowing liquid passage between the lower compartment and the upper compartment which are welded and joined.

In a probable embodiment of the present invention, the following step is provided: separately closing the end parts of the lower compartment and the upper compartment.

In a probable embodiment of the present invention, the following step is provided: connecting a connection part to the lower compartment from one end and to the upper compartment from the other end.

DETAILED DESCRIPTION OF THE INVENTION

In this detailed description, the subject matter flexible tank (20) is explained with references to examples without forming any restrictive effect only in order to make the subject more understandable.

Figure 1:
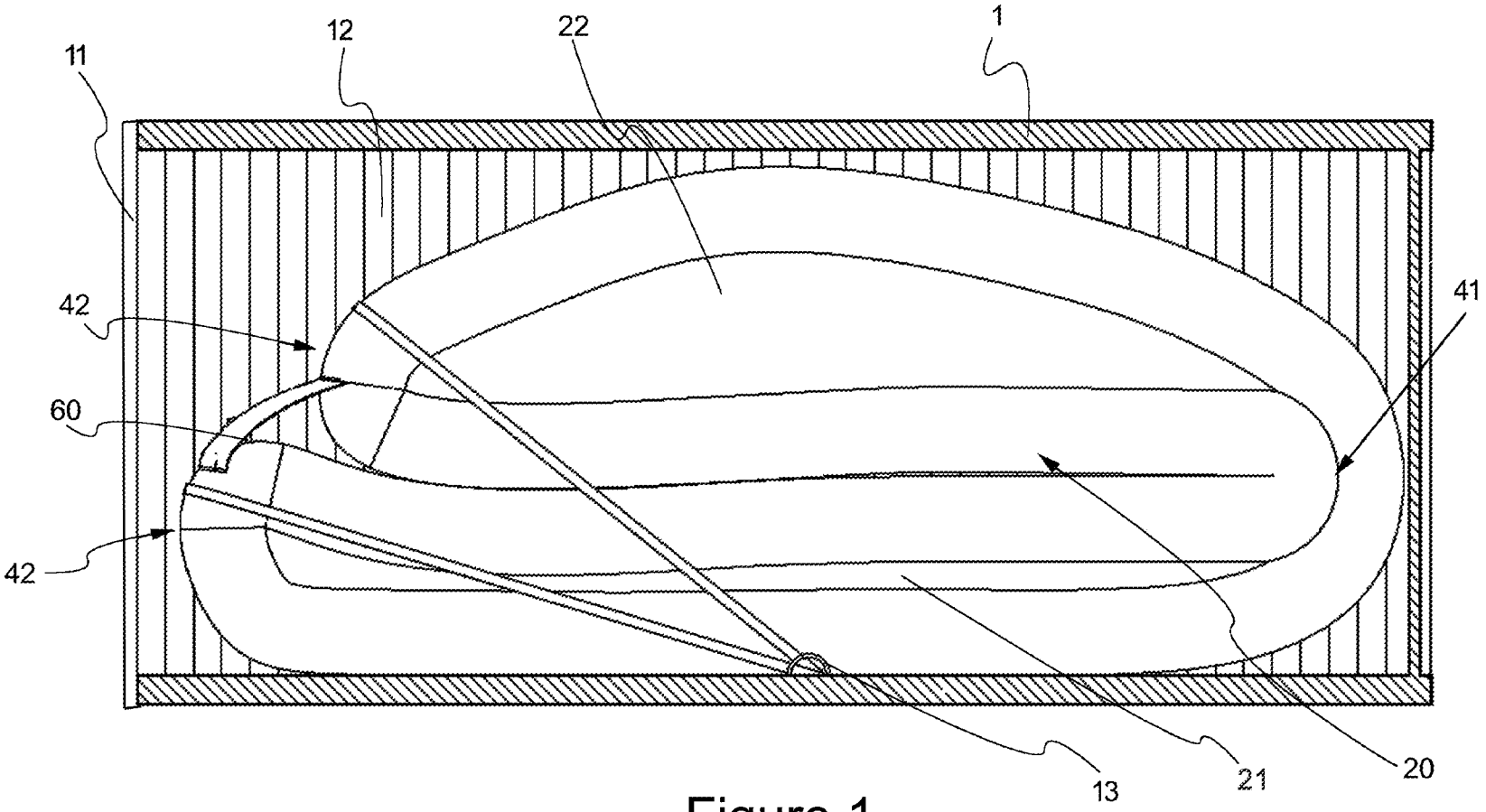
FIG. 1 is a representative lateral view of the subject matter flexible tank in the container.
Figure 2:
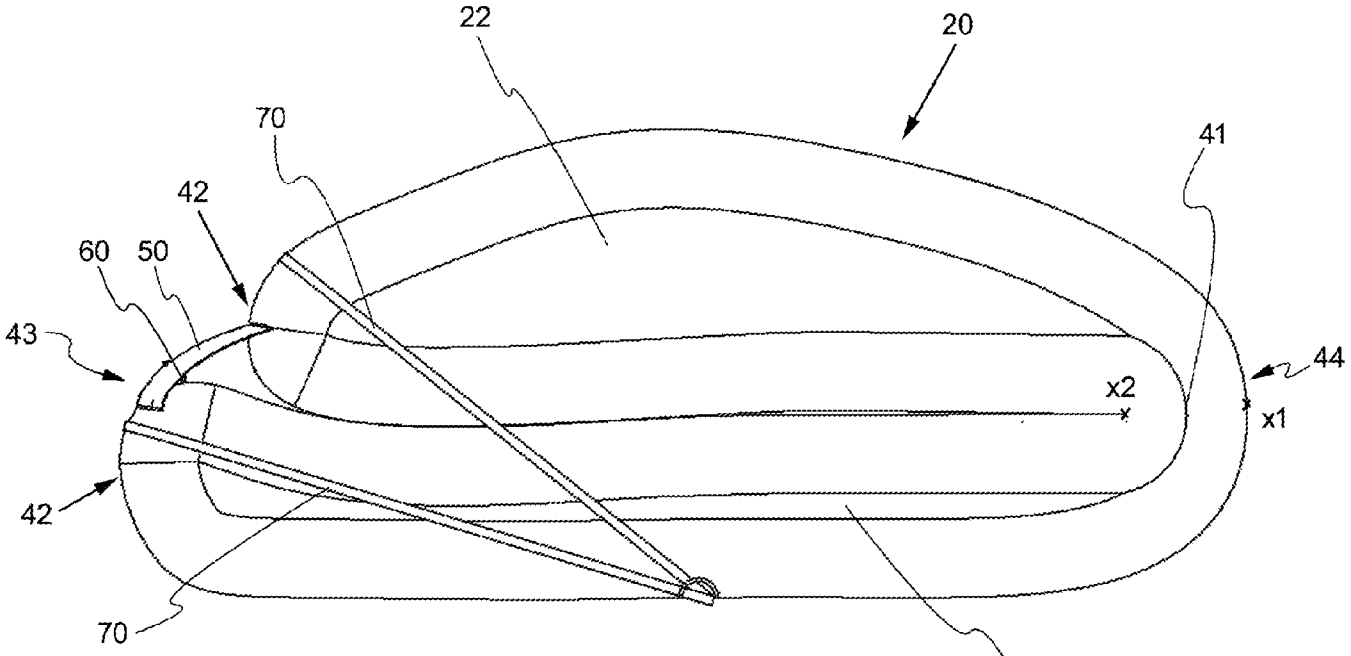
FIG. 2 is a representative lateral view of the subject matter flexible tank.

As can be seen in FIGS. 1 and 2, the subject matter flexible tank (20) comprises a tank body (40) having at least one lower compartment (21) and at least one upper compartment (22) positioned on said lower compartment (21).

Figure 3:
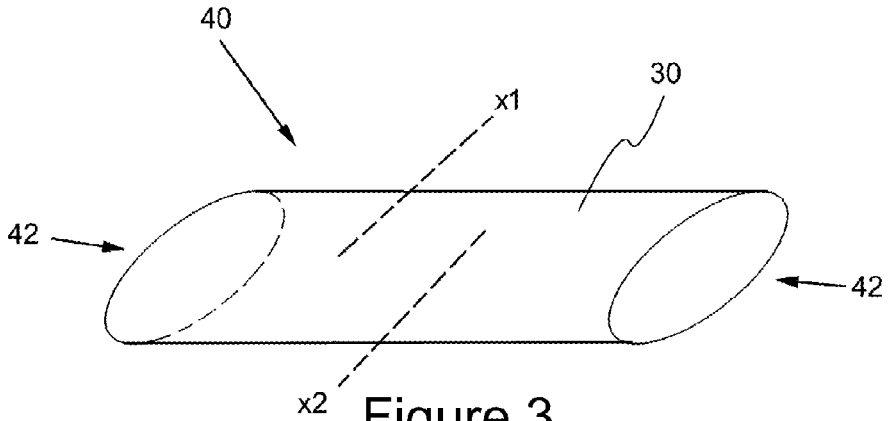
FIG. 3 is a representative view of the tank body of the subject matter flexible tank prior to folding.
Figure 4:
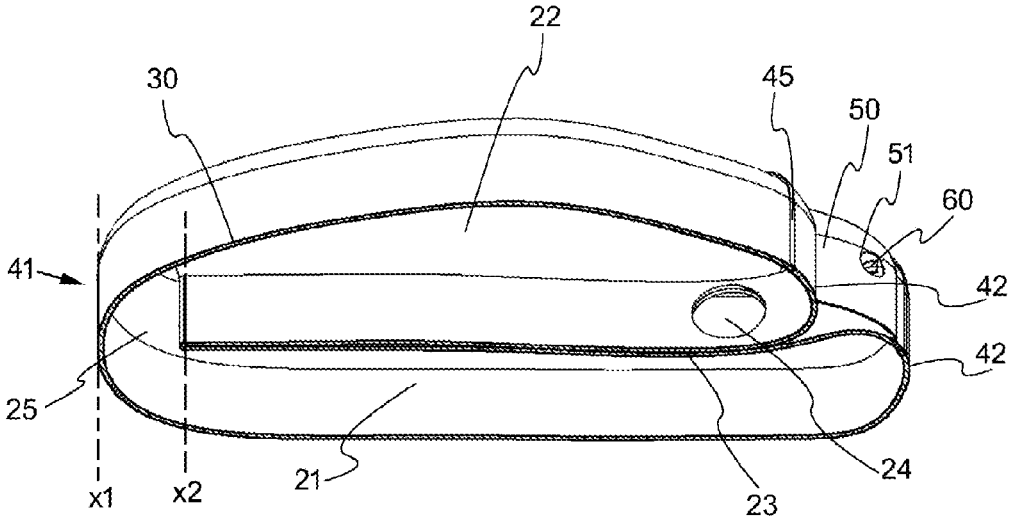
FIG. 4 is a representative longitudinal cross sectional view of the subject matter flexible tank.
Figure 5:
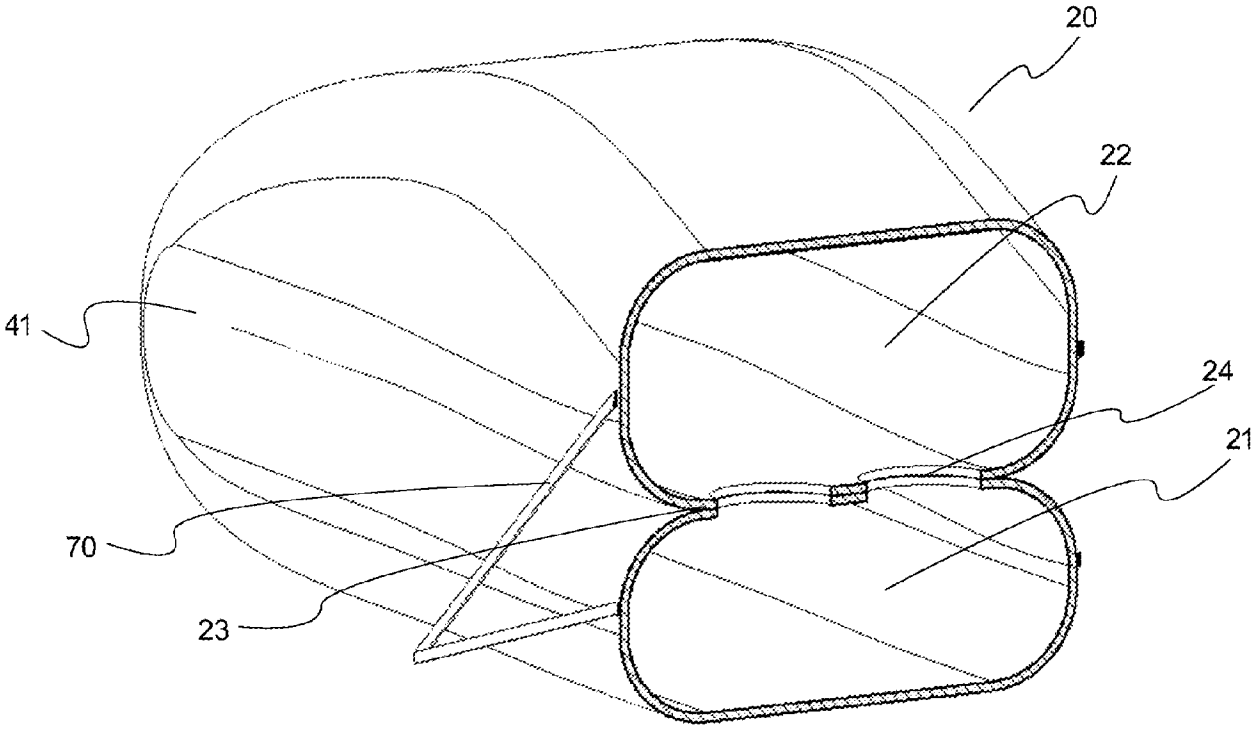
FIG. 5 is a representative transverse cross sectional view of the subject matter flexible tank.
Figure 6:
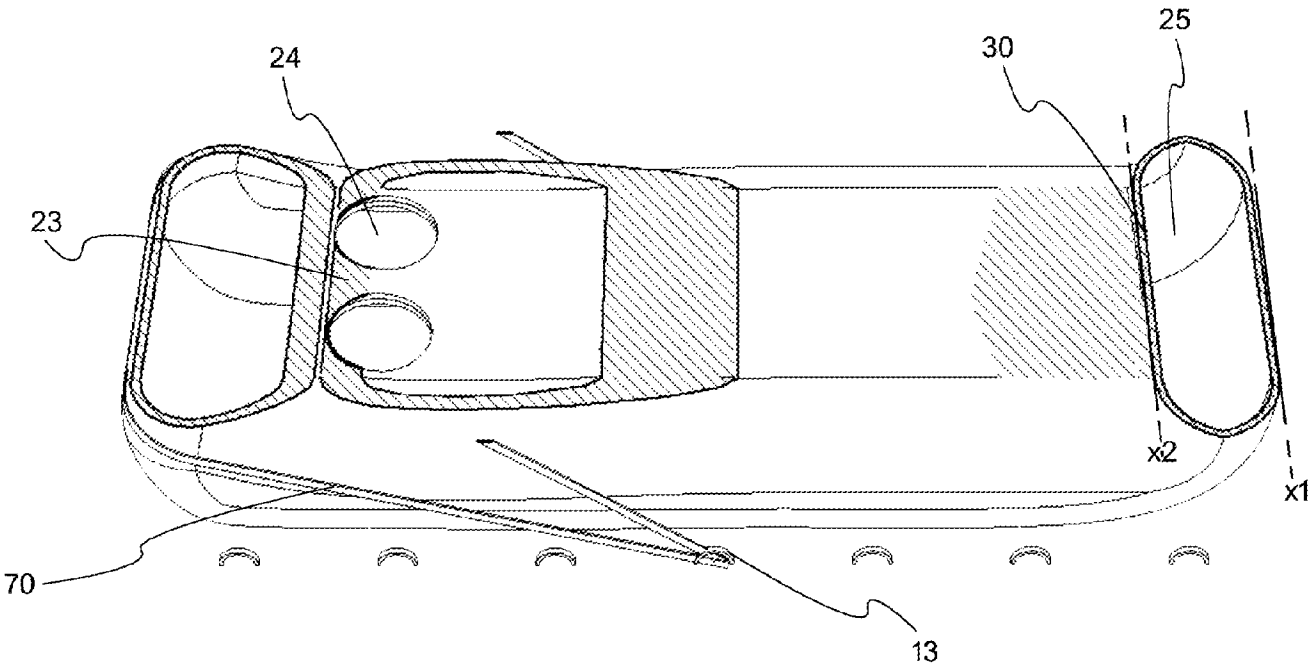
FIG. 6 is a representative cross sectional view between the lower compartment and the upper compartment of the subject matter flexible tank.

In more details, as can be seen in FIGS. 3, 4 and 5, the tank body (40) is obtained by bringing at least one flexible wall (30) into pipe form and by folding through a predetermined folding region (41) and by approaching the two ends to each other. In other words, there is at least one flexible wall (30) produced from flexible material. Said flexible wall (30) is brought into a pipe form by connecting two mutual ends to each other. Thus, a tank body (40) is obtained whose two ends are open. In a probable embodiment of the present invention, the flexible wall (30) may consist of pluralities of parts.

There is at least one first folding line (x1) and at least one second folding line (x2) at the folding region (41) defined on the tank body (40). The tank body (40) is folded from the first folding line (x1) and from the second folding line (x2) and is brought into a C-like form. Thus, the inner volume of the tank body (40) gains a C-like form. Accordingly, the part of the inner volume which remains in the lower arm is defined as a lower compartment (21) and the part of the inner volume which remains in the upper arm is defined as an upper compartment (22). The lower compartment (21) and the upper compartment (22) are connected to each other through the folding region (41). The section between the first folding line (x1) and the second folding line (x2) where the lower compartment (21) is connected to the upper compartment (22) is defined as a passage throttle (25). On the other hand, the end parts of the tank body (40) are provided so as to face the same direction. When the two ends of the tank body (40) coincide one above the other, the outer wall of the lower compartment (21) contacts the outer wall of the upper compartment (22). The section where the lower compartment (21) and the upper compartment (22) contact is defined as a joining region (23). The lower compartment (21) and the upper compartment (22) are connected to each other through said joining region (23). In a probable embodiment of the present invention, the connection process is realized by means of welding. While the upper compartment (22) and the lower compartment (21) are welded to each other, at least one passage opening (24) is formed. Thus, liquid passage between the lower compartment (21) and the upper compartment (22) through the passage opening (24) becomes possible. After the lower compartment (21) and the upper compartment (22) are welded to each other, the end part (42) of the lower compartment (21) and the upper part of the upper compartment (22) are closed separately. In a probable embodiment of the present invention, the end parts (42) are closed by means of welding the walls to each other. In another probable embodiment of the present invention, additional parts may be put to the end parts (42) and the end parts (42) may be covered.

There is at least one connection part (50) extending from the end part (42) of the upper compartment (22) towards the end part (42) of the lower compartment (21). Said connection part (50) connects the lower compartment (21) and the upper compartment (22) to each other. Thus, when liquid is filled into the flexible tank (20), the forces exerted on the welded regions as a result of the occurring hydrodynamic pressure are reduced.

In a probable embodiment of the present invention, the side where the end parts (42) of the upper compartment (22) and the lower compartment (21) are provided is defined as a front side (43) and the part where the folding region (41) is provided is defined as a rear side (44).

There is at least one valve (60) provided on the flexible tank (20). Said valve (60) can be provided in the vicinity of the rear side (44) where the folding region (41) is provided or in the vicinity of the front side (43) where the end parts (42) are provided. Accordingly, the flexible tank (20) can be positioned such that the front side (43) or the rear side (44) corresponds to the container door (11). When the valve (60) is provided at the end part (42) of the lower compartment (21), there is at least one opening (51) provided on the connection part (50) in order to provide access to the valve (60).

In a probable embodiment of the present invention, the folding region (41) is provided in a closer manner to an end part (42). Thus, when the upper compartment (22) is positioned on the lower compartment (21), the end part (42) of the upper compartment (22) is provided in a more rearward manner than the end part (42) of the lower compartment (21). Thus, when the flexible tank (20) is positioned in the container (1), the end part (42) is brought to the door side and the force, exerted by the liquid provided in the flexible tank (20) onto the door, is reduced.

Figure 7:
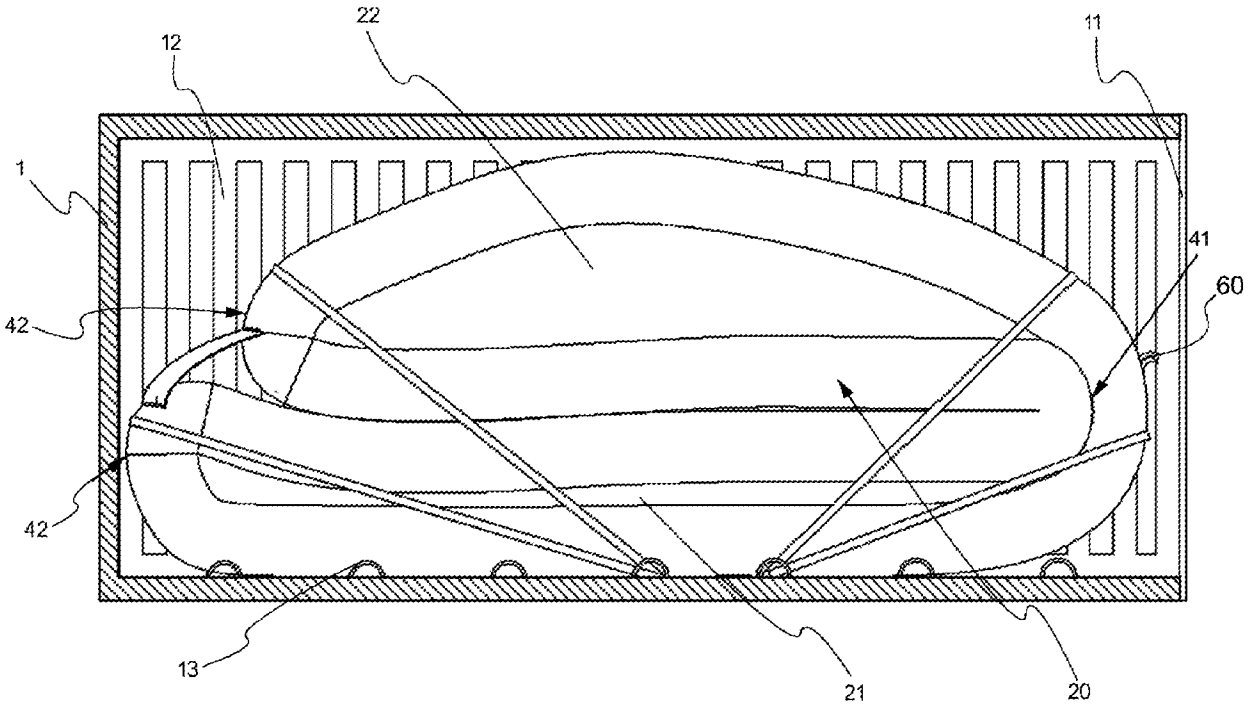
FIG. 7 is a representative lateral view of an alternative embodiment of the subject matter flexible tank in the container.

As can be seen in FIG. 1 and FIG. 7, in probable embodiments of the present invention, there is at least one tension belt (70) in order to provide fixation of the flexible tank (20) inside the container (1). Said tension belt (70) is connected to a connection element (13), provided in the vicinity of the base of the container (1), from one end thereof. The tension belt (70) extends from the connection element (13) onto the flexible tank (20) and it partially encircles the flexible tank (20) and it is connected to a connection element (13) which remains at the other side of the flexible tank (20). In a probable embodiment of the present invention, the tension belt (70) passes through the front side (43) of the flexible tank (20), in other words, the tension belt (70) passes through the vicinity of the end parts (42) thereof. In a probable embodiment of the present invention, there is at least one belt housing (45) provided at the outer wall of the flexible tank (20). The tension belt (70) passes through the belt housing (45). Thus, sliding of the tension belt (70) on the flexible tank (20) wall is prevented. In other words, the parts where the tension belt (70) will hold the flexible tank (20) are determined. In a probable embodiment of the present invention, the tension belt (70) passes through the end part (42) of the lower compartment (21), through the end part (42) of the upper compartment (22). There are two belt housings (45) provided at different heights at the other side of the flexible tank (20), in other words, at the rear side of the flexible tank (20), and fixation is realized by means of the two tension belts (70).

During the usage of the subject matter flexible tank (20), the flexible tank (20) is firstly positioned inside the container (1) in an empty manner. Afterwards, the flexible tank (20) is fixed by means of the tension belts (70). Afterwards, the flexible tank (20) is filled through the valve (60) part. The liquid, transferred into the flexible tank (20), firstly fills the lower compartment (21). After the lower compartment (21) is filled, the fluid, passing through the passage throttle (25) and passage openings (24), also fills the upper compartment (22). When the flexible tank (20) is desired to be discharged, the discharge of the liquid through the valve (60) becomes possible. Since the lower compartment (21) and the upper compartment (22) are integrated to each other, liquid passage through the throttle part is facilitated and discharge of the liquid, provided in the flexible tank (20), is facilitated. Thus, when the flexible tank (20) is discharged, less liquid when compared with the prior art remains in the flexible tank (20).

On the other hand, since the lower compartment (21) and the upper compartment (22) are formed of a whole tank body (40), the flexible tank (20) has a more resistant structure.

Moreover, since the lower compartment (21) and the upper compartment (22) are formed of a single tank body (40), an easier production method is formed when compared with the prior art. In other words, production of the flexible tank is provided by means of less number of process steps when compared with the prior art. Moreover, since the production method is simplified, fault risk during production is reduced.

Besides, since the tank body (40) is folded through the first folding line (x1) and through the second folding line (x2), the tank body (40) is folded in a curved manner at the folding region (41). In other words, the passage throttle (25) may have a bracket-like structure with a wide curve. By means of this, during liquid transportation with the flexible tank (20), the liquid changes direction in a smooth manner and the liquid displaces between the lower compartment (21) and the upper compartment (22). Meanwhile, liquid passage is provided through the passage opening (24) and the liquid can displace in cycled form.

The protection scope of the present invention is set forth in the annexed Claims and cannot be restricted to the illustrative disclosures given above, under the detailed description. It is because a person skilled in the relevant art can obviously produce similar embodiments under the light of the foregoing disclosures, without departing from the main principles of the present invention.

REFERENCE NUMBERS

1 Container
11 Container door
12 Side wall
13 Connection element
20 Flexible tank
21 Lower compartment
22 Upper compartment
23 Joining region
24 Passage opening
25 Passage throttle
30 Flexible wall
40 Tank body
41 Folding region
42 End part
43 Front side
44 Rear side
45 Belt housing
50 Connection part
51 Opening
60 Valve
70 Tension belt
X1 First folding line
X2 Second folding line

The invention claimed is:

1. A flexible tank configured to store liquid and configured to be placed into a container for transporting liquid from one location to another location by means of a motorized vehicle, the flexible tank comprising a lower compartment and an upper compartment positioned one above the other, wherein the lower compartment and the upper compartment are formed by a tank body that is formed by at least one flexible wall that is joined in a manner forming a flexible pipe-like form, wherein the tank body comprises a folding region having a first folding line and a second folding line configured such that a passage throttle is defined in between the first folding line and the second folding line, and wherein the folding region divides the tank body into the lower compartment and the upper compartment, and wherein the upper compartment comprises at least one joining region defined at a part thereof which seats onto the lower compartment and is welded thereto.

2. The flexible tank according to claim 1, wherein the upper compartment comprises an end part and the lower compartment comprises another end part, the folding region is closer to the end part of the upper compartment or the end part of the lower compartment.

3. The flexible tank according to claim 1, wherein at least one passage opening is provided at the joining region.

4. The flexible tank according to claim 1, wherein at least one connection part extends between an outer wall of the upper compartment and an outer wall of the lower compartment.

5. The flexible tank according to claim 4, wherein the connection part extends between an end part of the lower compartment and an end part of the upper compartment.

6. The flexible tank according to claim 1, wherein at least one valve is provided on the flexible tank.

7. The flexible tank according to claim 1, wherein at least one tension belt is connected to the tank body.

8. The flexible tank according to claim 7, wherein at least one belt housing is provided through which the at least one tension belt passes.

9. The flexible tank according to claim 8, wherein the at least one tension belt is positioned in a manner grabbing the tank body through the vicinity of an end part of the upper compartment.

10. The flexible tank according to claim 8, wherein the at least one tension belt is positioned in a manner grabbing the tank body through the vicinity of an end part of the lower compartment.

11. The flexible tank according to claim 8, wherein the at least one tension belt is positioned in a manner grabbing the tank body through the vicinity of the folding region.

12. The flexible tank according to claim 11, wherein the at least one tension belt comprises a plurality of tension belts provided such that there is a predetermined distance in between in the vicinity of the folding region.

13. A production method for producing the flexible tank according to claim 1, wherein the following steps are provided: bending and joining the at least one flexible wall and forming into the flexible pipe-like form and forming the tank body, folding the tank body through the folding region and welding and joining the upper compartment and the lower compartment, obtained after folding the tank body, through the at least one joining region.

14. The production method according to claim 13, wherein the following step is provided: forming at least one passage opening formed in a manner allowing liquid passage between the lower compartment and the upper compartment which are welded and joined.

15. The production method according to claim 13, wherein the following step is provided: separately closing an end part of the lower compartment and an end part of the upper compartment.

16. The production method according to claim 13, wherein the following step is provided: connecting a connection part to the lower compartment from one end and to the upper compartment from the other end.

* * * * *